US008555439B2

(12) United States Patent
Soto et al.

(10) Patent No.: US 8,555,439 B2
(45) Date of Patent: Oct. 15, 2013

(54) PADDED HEAD SUPPORT

(75) Inventors: Orlando Soto, Acton, MA (US); Dustin T. Libby, Belmont, MA (US); Thomas K. Skripps, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 277 days.

(21) Appl. No.: 12/948,818

(22) Filed: Nov. 18, 2010

(65) Prior Publication Data

US 2012/0124747 A1 May 24, 2012

(51) Int. Cl.
*A47B 7/00* (2006.01)

(52) U.S. Cl.
USPC ..... 5/622; 5/637; 128/870; 128/869

(58) Field of Classification Search
USPC ..... 5/636, 640, 637, 639, 638, 643, 628; 128/870, 869, 846
See application file for complete search history.

(56) References Cited

U.S. PATENT DOCUMENTS

| | | | |
|---|---|---|---|
| 320,806 | A | 6/1885 | Long |
| 933,471 | A | 9/1909 | Leahy |
| 1,728,025 | A | 9/1929 | Weber |
| 2,306,031 | A | 12/1942 | Anderson et al. |
| 2,452,816 | A | 11/1948 | Wagner |
| 2,509,086 | A | 5/1950 | Eaton |
| 2,688,142 | A | 9/1954 | Jensen |
| 3,042,025 | A | 7/1962 | Jackson |
| 3,099,441 | A | 7/1963 | Ries |
| 3,188,079 | A | 6/1965 | Boetcker et al. |
| 3,223,447 | A | 12/1965 | Terracini |
| 3,572,835 | A | 3/1971 | Kees, Jr. et al. |
| 3,609,779 | A | 10/1971 | Oja et al. |
| 3,828,377 | A | 8/1974 | Fary, Sr. |
| 3,854,772 | A | 12/1974 | Abrahamson et al. |
| 3,897,777 | A | 8/1975 | Morrison |
| 3,947,686 | A | 3/1976 | Cooper et al. |
| 3,957,262 | A | 5/1976 | McReynolds |
| 4,018,412 | A | 4/1977 | Kees, Jr. et al. |
| 4,021,028 | A | 5/1977 | Weber et al. |
| 4,033,339 | A | 7/1977 | Roberts et al. |
| 4,034,748 | A | 7/1977 | Winner |
| 4,054,282 | A | 10/1977 | Hamer |
| 4,108,426 | A | 8/1978 | Lindstroem et al. |
| 4,139,917 | A | 2/1979 | Fenwick |
| 4,169,478 | A | 10/1979 | Hickmann |
| 4,225,125 | A | 9/1980 | Lee |

(Continued)

FOREIGN PATENT DOCUMENTS

WO WO 2005/020819 3/2005

OTHER PUBLICATIONS

2005 Catalog Passionate About Positioning, Allen Medical Systems, A Hill-Rom Company; dated Dec. 2004.

*Primary Examiner* — Peter M Cuomo
*Assistant Examiner* — Brittany Wilson
(74) *Attorney, Agent, or Firm* — Barnes & Thornburg LLP

(57) ABSTRACT

A padded head support for use during surgery includes a head wrap and a chin wrap. The head wrap includes a headrest pad adapted to cover the back of a patient's head and a forehead band having a first portion and a second portion extending from the headrest pad to form a first closed loop around a patient's head. The chin wrap includes a chin pad adapted to cover the bottom of a patient's chin and a chin band having a first portion and a second portion extending from the chin pad to form a second closed loop around a patient's head.

28 Claims, 6 Drawing Sheets

(56) References Cited

U.S. PATENT DOCUMENTS

| | | | |
|---|---|---|---|
| 4,243,025 | A | 1/1981 | Jones |
| 4,378,108 | A | 3/1983 | Bailey, Jr. |
| 4,387,888 | A | 6/1983 | Marinakis |
| D271,834 | S | 12/1983 | Huntsinger |
| 4,474,364 | A | 10/1984 | Brendgord |
| 4,484,911 | A | 11/1984 | Berlin et al. |
| 4,504,050 | A | 3/1985 | Osborne |
| 4,526,355 | A | 7/1985 | Moore et al. |
| 4,545,572 | A | 10/1985 | Day |
| 4,620,697 | A | 11/1986 | Pithon |
| 4,671,728 | A | 6/1987 | Clark et al. |
| 4,678,232 | A | 7/1987 | Ishida et al. |
| 4,752,064 | A | 6/1988 | Voss |
| 4,757,983 | A | 7/1988 | Ray et al. |
| 4,823,776 | A | 4/1989 | Foster et al. |
| 4,840,363 | A | 6/1989 | McConnell |
| 4,852,840 | A | 8/1989 | Marks |
| 4,865,484 | A | 9/1989 | McConnell |
| 4,923,187 | A | 5/1990 | Mombrinie |
| 4,979,519 | A | 12/1990 | Chavarria et al. |
| 4,989,848 | A | 2/1991 | Monroe |
| 4,995,067 | A | 2/1991 | Royster et al. |
| 5,081,665 | A | 1/1992 | Kostich |
| 5,088,706 | A | 2/1992 | Jackson |
| 5,131,106 | A | 7/1992 | Jackson |
| 5,177,823 | A | 1/1993 | Riach |
| 5,207,716 | A | 5/1993 | McReynolds et al. |
| 5,214,815 | A | 6/1993 | Agbodoe et al. |
| 5,220,699 | A | 6/1993 | Farris |
| 5,233,713 | A | 8/1993 | Murphy et al. |
| 5,269,035 | A | 12/1993 | Hartunian |
| 5,276,927 | A | 1/1994 | Day |
| 5,317,771 | A | 6/1994 | Cook |
| 5,408,713 | A | 4/1995 | Stratton et al. |
| 5,427,436 | A | 6/1995 | Lloyd |
| 5,444,882 | A | 8/1995 | Andrews et al. |
| 5,515,867 | A | 5/1996 | Lamb |
| 5,520,623 | A | 5/1996 | Williams |
| 5,524,639 | A | 6/1996 | Lanier et al. |
| 5,531,229 | A | 7/1996 | Dean et al. |
| 5,564,663 | A | 10/1996 | Cook et al. |
| 5,569,175 | A | 10/1996 | Chitwood |
| 5,613,254 | A | 3/1997 | Clayman et al. |
| 5,613,501 | A | 3/1997 | Michelson |
| 5,615,432 | A | 4/1997 | Von Ohlen, III |
| 5,642,302 | A | 6/1997 | Dumont et al. |
| 5,661,859 | A | 9/1997 | Schaefer |
| 5,741,210 | A | 4/1998 | Dobrovolny |
| 5,758,374 | A | 6/1998 | Ronci |
| 5,916,189 | A | 6/1999 | Sullenperger et al. |
| 5,926,876 | A | 7/1999 | Haigh et al. |
| D414,974 | S | 10/1999 | Marrone, II et al. |
| 5,960,494 | A | 10/1999 | Gilliland et al. |
| 6,065,165 | A | 5/2000 | Delk et al. |
| 6,076,208 | A | 6/2000 | Heimbrock et al. |
| 6,108,840 | A | 8/2000 | Heimbrock et al. |
| 6,112,333 | A | 9/2000 | Mazzei |
| 6,120,397 | A | 9/2000 | Julian |
| 6,138,302 | A | 10/2000 | Sashin et al. |
| 6,138,304 | A | 10/2000 | Lipsky et al. |
| 6,151,734 | A | 11/2000 | Lawrie |
| 6,154,903 | A | 12/2000 | Wai-Chung |
| 6,199,552 | B1 | 3/2001 | Crespo |
| 6,202,230 | B1 | 3/2001 | Borders |
| 6,249,923 | B1 | 6/2001 | Heimbrock et al. |
| 6,260,220 | B1 | 7/2001 | Lamb et al. |
| 6,276,012 | B2 | 8/2001 | Borders |
| 6,374,439 | B2 | 4/2002 | Heimbrock et al. |
| 6,397,414 | B1 | 6/2002 | Lloyd |
| 6,427,273 | B1 | 8/2002 | Berke et al. |
| 6,442,777 | B1 | 9/2002 | Pauli |
| 6,446,287 | B2 | 9/2002 | Borders |
| 6,490,737 | B1 | 12/2002 | Mazzei et al. |
| 6,510,852 | B1 | 1/2003 | Shiery et al. |
| 6,532,609 | B2 | 3/2003 | Taylor et al. |
| 6,557,195 | B2 | 5/2003 | Dinkler |
| 6,561,194 | B2 | 5/2003 | Michelson |
| 6,564,406 | B2 | 5/2003 | VanSteenburg et al. |
| 6,578,215 | B1 | 6/2003 | Heimbrock et al. |
| 6,594,839 | B1 | 7/2003 | Papay |
| 6,616,236 | B1 | 9/2003 | Su |
| 6,622,324 | B2 | 9/2003 | VanSteenburg et al. |
| 6,637,058 | B1 | 10/2003 | Lamb |
| 6,701,553 | B1 | 3/2004 | Hand et al. |
| 6,718,580 | B2 | 4/2004 | Heimbrock et al. |
| 6,718,582 | B1 | 4/2004 | Tinsley |
| 6,739,006 | B2 | 5/2004 | Newkirk et al. |
| 6,754,923 | B2 | 6/2004 | Borders et al. |
| D497,430 | S | 10/2004 | Tinsley |
| 6,928,676 | B1 | 8/2005 | Schwaegerle |
| 7,017,211 | B2 | 3/2006 | Krywiczanin et al. |
| 7,089,613 | B2 | 8/2006 | Cohen |
| 7,117,551 | B1 | 10/2006 | Dinkler et al. |
| 7,407,231 | B2 | 8/2008 | Kraft et al. |
| 7,544,007 | B2 | 6/2009 | Easton |
| 7,770,977 | B2 | 8/2010 | Diller |
| 7,882,583 | B2 | 2/2011 | Skripps |
| 2002/0061225 | A1 | 5/2002 | Boucher et al. |
| 2003/0115674 | A1 | 6/2003 | Heimbrock et al. |
| 2004/0123389 | A1 | 7/2004 | Boucher et al. |
| 2006/0253985 | A1 | 11/2006 | Skripps |
| 2008/0078031 | A1 | 4/2008 | Weinstein et al. |
| 2009/0079251 | A1 | 3/2009 | Diller |

PADDED HEAD SUPPORT

BACKGROUND

The present disclosure relates to a patient support apparatus, for supporting a patient during surgery. More particularly, the present disclosure relates to a padded head support.

Often, when a patient is sedated for a surgery, the patient is supported by and secured to braces or supports coupled to a surgical table. Sometimes, pads are inserted at the interface of the patient's body and some of the braces or supports.

Pads known in the art are often secured to a surgical brace or support before a patient is supported or secured to the brace or support. Such pads can be difficult to secure to a patient and may allow unwanted movement of the patient relative to the brace or support.

SUMMARY

A padded head support has one or more of the features recited in the appended claims and/or the following features which, alone or in any combination, may comprise patentable subject matter:

A padded head support for use with a surgical head support apparatus having a headrest is disclosed. The padded head support may include a head wrap and a chin wrap. The head wrap may include a head wrap coupler and a headrest pad. The headrest pad may be adapted to be secured to the surgical head support apparatus. The chin wrap may include a chin wrap coupler. The head wrap may form a first closed loop around a patient's forehead and a back of the patient's head. The chin wrap may form a second closed loop around the patient's chin and a top of the patient's head. The chin wrap may also engage the head wrap at two locations. The head wrap coupler may hold the head wrap in the first closed loop, and the chin wrap coupler may hold the chin wrap in the second closed loop.

In some embodiments, the head wrap may further include a forehead band. The forehead band may have a first portion extending from a first side of the headrest pad and a second portion extending from a second side of the headrest pad. The second side of the headrest pad may be spaced apart from the first side of the headrest pad. The head wrap coupler may be coupled to the first portion of the forehead band and may engage the second portion of the forehead band.

It is contemplated that the headrest pad may have a top surface and a bottom surface. The first portion and the second portion of the forehead band may also have a top surface and a bottom surface. The bottom surface of the headrest pad may extend below the bottom surface of the first portion and the second portion of the forehead band.

The head wrap coupler may face outwardly from a first side of the head wrap and may be configured to engage a second side of the head wrap. The head wrap may be made from a material that adheres to hook material. In such embodiments, the head wrap coupler may be made from hook material.

In some embodiments, the chin wrap may include a chin pad and a chin band. The chin band may have a first portion extending from a first side of the chin pad and a second portion extending from a second side of the chin pad. The second side of the chin pad may be spaced apart from the first side. The chin wrap coupler may be coupled to the first portion of the chin band and may engage the second portion of the chin band.

According to this disclosure, therefore, a padded head support for use with a surgical head support apparatus having a headrest and a headrest securing member is disclosed. The padded head support may include a head wrap and a chin wrap. The head wrap may include a headrest pad and a forehead band. The forehead band may have a first portion extending from a first side of the headrest pad and a second portion extending from a second side of the headrest pad. The head wrap may be movable between a first position and a second position. In the first position of the head wrap, the first portion and the second portion of the forehead band may be positioned in spaced apart relation from one another. In the second position of the head wrap, the first portion and the second portion of the forehead band may be engaged with one another and the head wrap may form a first closed loop.

The head wrap may further include a head wrap coupler. The head wrap coupler may be situated between the first portion and the second portion of the forehead band when the forehead band is in the second position. Additionally, the headrest pad may be secured to the headrest when the forehead band is in the second position. Further, the forehead band may be situated between the headrest and the headrest securing member when the forehead band is in the second position.

In some embodiments, the chin wrap may include a chin pad and a chin band. The chin band may have a first portion extending from a first side of the chin pad and a second portion extending from a second side of the chin pad. The chin wrap may be movable between a first position and a second position. In the first position of the chin wrap, the first portion and the second portion of the chin band may be positioned in spaced apart relation from one another. In the second position of the chin wrap, the first portion and the second portion of the chin band may be engaged with one another forming a second closed loop with the chin pad.

It is contemplated that the chin band may engage the forehead band in two locations when the forehead band is in the second position and the chin band is in the second position. Also, the chin band may be situated between the forehead band and the headrest securing member at the two locations where the chin band engages the forehead band. The chin wrap may also include a chin wrap coupler. The chin wrap coupler may be situated between the first portion and the second portion of the chin band when the chin band is in the second position.

The present disclosure also teaches a method of wrapping a patient's head in a padded head support and coupling the padded head support to a surgical table having a surgical head support apparatus. The method may include wrapping a head wrap, wrapping a chin wrap, and securing the padded head support to the surgical support apparatus. Wrapping the head wrap may include wrapping a headrest pad and a forehead band around the patient's head so that the headrest pad is positioned to cover the back of the patient's head and the forehead band is positioned to cover the patient's forehead. Wrapping a chin wrap may include wrapping the chin wrap around the patient's head so that the chin wrap is positioned under the patient's chin and the chin wrap engages the head wrap at two locations.

In some embodiments of the method, the head wrap and the chin wrap are wrapped around the patient's head before securing the padded head support to the surgical head support apparatus. It is contemplated that the method might include securing the headrest pad to the surgical head support apparatus by wrapping a strap of the surgical head support apparatus around the head wrap or attaching a first coupler of the head wrap to a second coupler of the surgical head support apparatus According to this disclosure, a patient head support for use with a surgical table may include a padded head support, a surgical head support apparatus, and an operating room table adapter. The padded head support may include a head wrap having a head wrap coupler and a chin wrap having a chin wrap coupler. The surgical head support apparatus may include a head support with a first coupler, a bracket, and a joint member. The joint member may be situated between the head support and the bracket and may be coupled to the head support and to the bracket. The operating room table adapter may include an adapter board, at least one rail extending beyond the adapter board, and at least one coupler securing the adapter board to a surgical table. The padded head support may further be adapted to be secured to the surgical head support apparatus. The head wrap may form a first closed loop around a patient's forehead and a back of the patient's head. The chin wrap may form a second closed loop around the patient's chin and a top of the patient's head. The chin wrap may engage the head wrap at two locations. The head wrap coupler may hold the head wrap in the first closed loop, and the chin wrap coupler may hold the chin wrap in the second closed loop.

It is contemplated that the at least one coupler of the operating room table adapter is a hook material patch, a loop material patch, or a strap. In some embodiments, the joint member of the surgical head support apparatus may engage a first spherical joint extending from the head support and a second spherical joint extending from the bracket. In such embodiments, the joint member may be movable between a locked position, blocking movement of the first and the second spherical joints, and an unlocked position, allowing movement of the first and the second spherical joints. The joint member may be moved between the locked position and the unlocked position by a joint lock knob.

The head wrap of the padded head support may adapted to be secured to the head support of the surgical head support apparatus. The padded head support may be secured to the head support by a hook material patch, a loop material patch, or a strap. The hook material patch may be situated between the padded head support and the head support. The loop material patch may be situated between the padded head support and the head support. The strap may extend over at least a portion of the head wrap.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION

Figure 1:
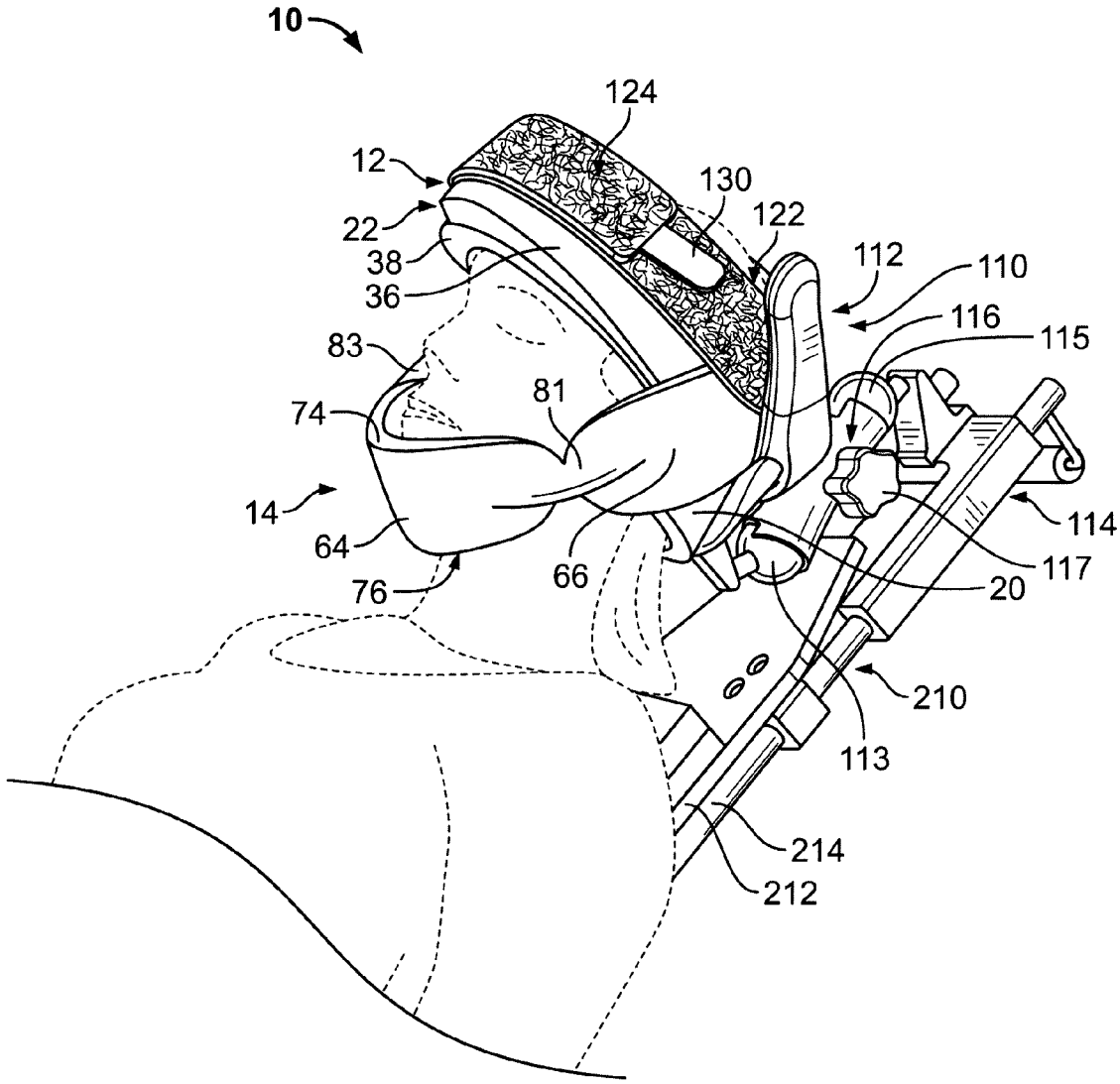
FIG. 1 is a perspective view of a padded head support showing a head wrap covering the back of a patient's head and forming a closed loop and a chin wrap covering a patient's chin and forming a closed loop, the padded head support secured to a surgical head support apparatus.
Figure 2:
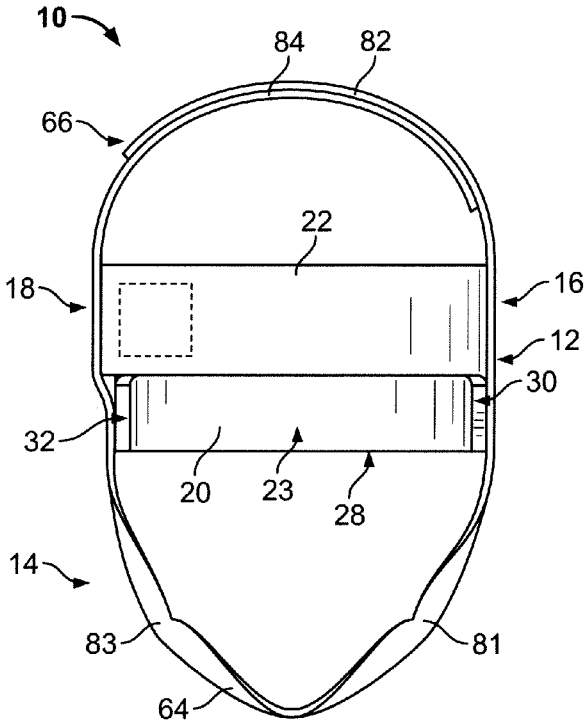
FIG. 2 is a front elevation view of the padded head support of FIG. 1 showing the head wrap including a head pad extending below a forehead band and the chin wrap includes a chin pad with pinch joints and a chin band passing over the head wrap.
Figure 3:
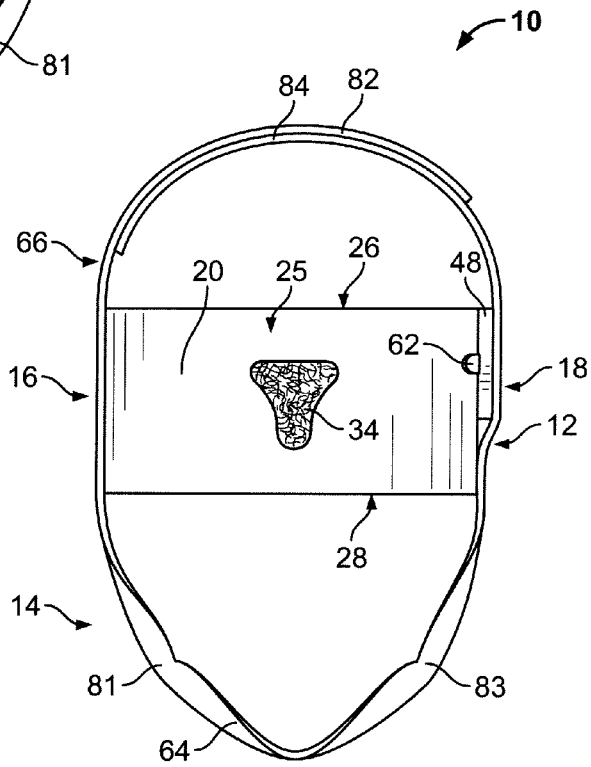
FIG. 3 is a rear elevation view of the padded head support of FIG. 1 showing the head pad of the head support having a headrest coupler.

A padded head support 10 includes a head wrap 12 and a chin wrap 14 as shown in FIG. 1. The head wrap 12 forms a closed loop around a patient's forehead and a back of the patient's head. The chin wrap 14 engages the head wrap 12 at a first location 16 and a second location 18 as shown in FIGS. 2 and 3. The chin wrap 14 also forms a closed loop around a patient's chin and a top of the patient's head.

Figure 4:
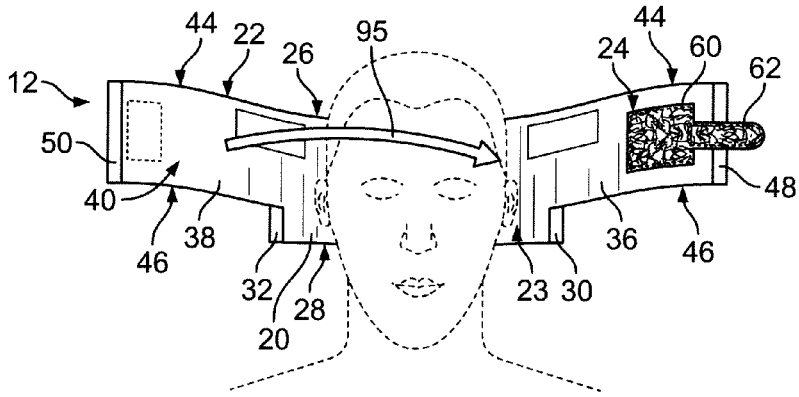
FIG. 4 is a front elevation view of the head wrap of FIG. 1 moved to an open position and including a head wrap coupler having a coupler patch and a pull tab.
Figure 5:
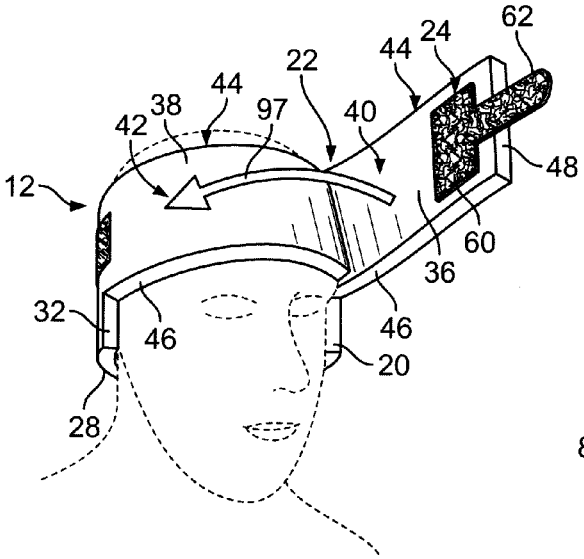
FIG. 5 is a perspective view of the head wrap of FIG. 1 moving from the open position to a wrapped position.

The head wrap 12 includes a headrest pad 20, a forehead band 22, and a head wrap coupler 24 as shown in FIGS. 4 and 5. The headrest pad 20 and the forehead band 22 include a material that adheres to hook material such as loop material. The headrest pad 20 and the forehead band 22 are illustratively formed from a monolithic piece of material as shown in FIGS. 2-5. In some embodiments, the headrest pad 20 and the forehead band 22 may be separately formed from a material that doesn't adhere to hook material.

The headrest pad 20 has a front side 23, a back side 25, a top edge 26, a bottom edge 28, a left edge 30, and a right edge 32 as shown in FIGS. 2-4. Left and right designations for purposes of the illustrative embodiment correspond to a left side and a right side of a patient. In other embodiments, left and right designations may correspond to the left and the right side of a caregiver facing a patient. The headrest pad 20 includes a headrest coupler 34 coupled to the headrest pad 20 and facing outwardly from the back side 24 of the headrest pad 20 as shown in FIG. 3. The headrest pad 20 is adapted to cover the back of a patient's head while the patient is in surgery.

The forehead band 22 includes a first or left portion 36 and a second or right portion 38 as shown in FIGS. 4 and 5. The forehead band 22 has a front side 40, a back side 42, a top edge 44, a bottom edge 46, a left edge 48 and a right edge 50. The left portion 36 of the forehead band 22 extends from the left edge 30 of the headrest pad 20. The right portion 38 of the forehead band 22 extends from the right edge 32 of the headrest pad 20. The bottom edge 28 of the headrest pad 20 extends beyond the bottom edge 46 of the forehead band 22. The forehead band 22 is adapted to extend over a patient's forehead as shown in FIGS. 4-6.

The head wrap coupler 24 includes a coupler patch 60 and a pull tab 62 as shown in FIGS. 4 and 5. The coupler patch 60 is coupled to the left portion 36 of the forehead band 22 and faces outwardly from the front side 40 of the forehead band 22. The coupler patch 60 is operable to engage the back side 42 of the right portion 38 of the forehead band 22. In the illustrative embodiment, the coupler patch 60 is made from hook material. The pull tab 62 is coupled to the coupler patch 60 and to the front side 40 of the forehead band 22. The pull tab 62 extends beyond the left edge 48 of the forehead band 22. In other embodiments, the head wrap coupler 24 may comprise a clip, a clasp, a buckle, or the like.

The chin wrap 14 includes a chin pad 64, a chin band 66, and a chin wrap coupler 68. The chin pad 64 and the chin band 66 include a material that adheres to hook material such as loop material. The chin pad 64 and the chin band 66 are illustratively formed from a monolithic piece of material as shown in FIGS. 2, 3, and 6. In some embodiments, the chin pad 20 and the chin band 66 may be separately formed from a material that doesn't adhere to hook material.

Figure 6:
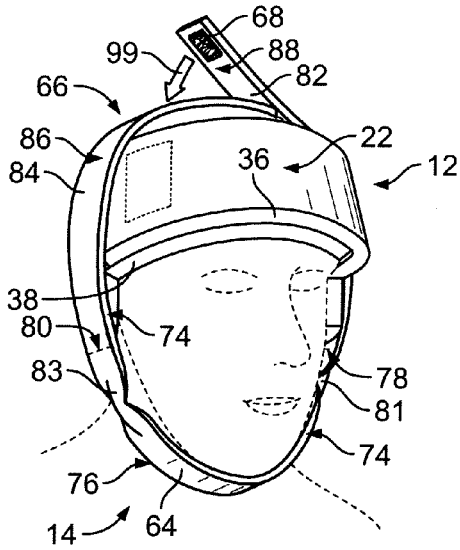
FIG. 6 is a perspective view of the padded head support of FIG. 1 with the chin wrap including a chin wrap coupler and the chin wrap moving from an open position to a wrapped position.

The chin pad 64 has a front edge 74, a back edge 76, a left edge 78, and a right edge 80 as shown in FIG. 6. The chin pad 64 also includes a left pinch joint 81 and a right pinch joint 83 situated at the left and the right edges 78, 80 of the chin pad 64, respectively. The chin pad 64 is adapted to cover a bottom side of a patient's chin. The chin pad 64 may be operable to hold a patient's mouth closed or to hold a patient's mouth in a desired position relative to anesthesia or other tubing when the patient is in surgery.

The left and the right pinch joints 81, 83 are formed by pinching together and securing the front edge 74 to the back edge 76 of the chin pad 64 as shown in FIGS. 1 and 6-8. In the illustrative embodiment, the front edge 74 of the chin pad 64 is secured to the back edge 76 of the chin pad 64 to form the left and the right pinch joints 81, 83 by an adhesive. In other embodiments, the pinch joints 81, 83 are omitted from the chin pad 64.

The chin band 66 includes a first or left portion 82 and a second or right portion 84. The chin band 66 has a top side 86 and a bottom side 88. The left portion 82 and the right portion 84 of the chin band 66 extend from the left pinch joint 81 and the right pinch joint 83 of the chin pad 64, respectively. The chin band 66 is adapted to extend over a top of a patient's head.

The chin wrap coupler 68 includes a coupler patch 98 as shown in FIG. 6. The coupler patch 98 is coupled to the left portion 82 of the chin band 66 and faces outwardly from the bottom side 88 of the chin band 66. The coupler patch 98 is operable to engage the top side 86 of the right portion 84 of the chin band 66. In the illustrative embodiment, the coupler patch 98 is made from hook material. In other embodiments, the chin wrap coupler 68 may be a clip, a clasp, a buckle, or the like.

The head wrap 12 is movable between an open position and a wrapped position. When the head wrap 12 is in the open position, the left portion 36 and the right portion 38 of the forehead band 22 are spaced apart from one another and the coupler patch 60 of the head wrap coupler 24 is not engaged with the back side 42 of the right portion 38 of the forehead band as shown in FIG. 4. When the head wrap 12 is moved to the wrapped position, the right portion 38 of the forehead band 22 is pulled over a patient's forehead as indicated by arrow 95 shown in FIG. 4. Then the left portion 36 of the forehead band 22 is pulled over the right portion 38 of the forehead band 22 as indicated by arrow 97 shown in FIG. 5. The pull tab 62 of the head wrap coupler 24 is operable to pull the left portion 36 of the forehead band 22 tight over the right portion 38 of the forehead band 22. When the head wrap 12 is in the wrapped position, the coupler patch 60 of the head wrap coupler 24 is engaged with the back side 42 of the right portion 38 of the forehead band. Further, when the head wrap 12 is in the wrapped position, the head wrap 12 forms a closed loop around a patient's forehead and a back of the patient's head.

The chin wrap 14 is movable between an open position and a wrapped position. When the chin wrap 14 is in the open position, the left portion 82 and the right portion 84 of the chin band 66 are spaced apart from one another and the coupler patch 98 is not engaged with the top side 86 of the right portion 84 of the chin band 66. When the chin wrap 14 is moved to the wrapped position, the right portion 84 of the chin band 66 is pulled over a top of a patients head. Then the left portion 82 of the chin band 66 is pulled over the right portion 84 of the chin band 66 as indicated by arrow 99 shown in FIG. 6. When the chin wrap 14 is in the wrapped position, the coupler patch 98 of the chin wrap coupler 68 is engaged with the top side 86 of the right portion 84 of the chin band 66. Further, when the chin wrap 14 is in the wrapped position, the chin wrap 14 forms a closed loop around a patient's chin and a top of the patient's head.

Illustratively, the head wrap 12 is moved from the open position to the wrapped position before the chin wrap 14 is moved from the open position to the wrapped position as shown in FIGS. 4-6. When both wraps 12, 14 are in the wrapped positions, the chin wrap 14 overlies and engages the head wrap 12 at the first location 16 and the second location 18. In other embodiments, the order of moving the wraps 12, 14 from the open to the wrapped positions may be reversed. That is, the chin wrap 14 may be put on the patient first, then the head wrap may be put on the patient.

The padded head support 10 is configured to be coupled to a surgical head support apparatus 110 as shown in FIG. 1. The surgical head support apparatus 110 includes a head support 112, a bracket 114, and a joint member 116. The head support 112 includes a first spherical joint 113 extending from the head support 112. The bracket 114 includes a second spherical joint 115 extending from the bracket 114. The joint member 116 engages both the first and the second spherical joints 113, 115. The joint member 116 is movable between a locked position, wherein the first and the second spherical joints 113, 115 are movable relative to the joint member 116, and an unlocked position wherein the first and the second spherical joints 113, 115 are blocked from movement relative to the joint member 116. The joint member 116 is movable between the locked and the unlocked position by a joint lock knob 117. The head support 112 is movable in three dimensions relative to the bracket 114 when the joint member 116 is moved to the unlocked position.

Figure 7:
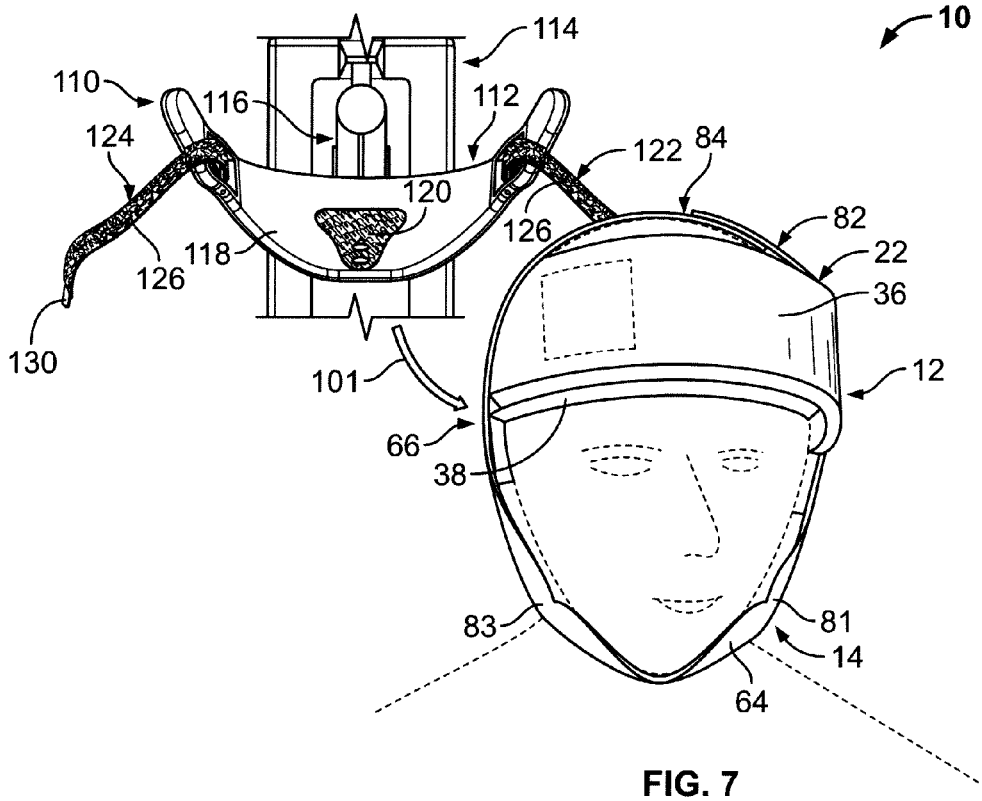
FIG. 7 is a perspective view of the padded head support and the surgical head support apparatus of FIG. 1, the surgical head support apparatus including a headrest with a first coupler patch configured to engage the headrest coupler of the padded head support.
Figure 8:
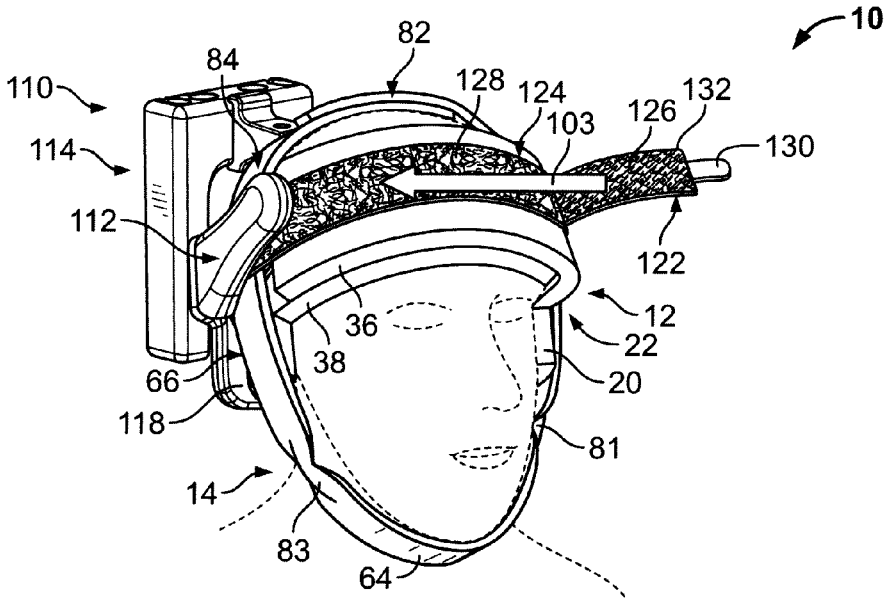
FIG. 8 is a perspective view of the padded head support and the surgical head support apparatus of FIG. 1, the padded head support being secured to the surgical head support by a first and a second strap of the surgical head support apparatus that wrap around the forehead band of the padded head support.

The head support 112 includes a headrest 118 having a first coupler patch 120, a first or left strap 122, and a second or right strap 124 as shown in FIGS. 7 and 8. The first coupler patch 120 is a piece of male Velcro material, also known as hook material, covering a portion of a front side 124 of the headrest 118. The first coupler patch 120 is configured to couple to the headrest coupler 34 of the headrest pad 20.

The first strap 122 and the second strap 124 include a first side 126, a second side 128, and a pull tab 130. The first sides 126 of the first and the second straps 122, 124, are male Velcro material, sometimes referred to as hook material. The second sides 128, of the first and the second straps 122, 124, are female Velcro material, sometimes referred to as loop material. The pull tabs 132 are situated at a first end 134 of the first and the second straps 122, 124, respectively.

When a patient's head is supported by the head support 112, the first and the second straps 122, 124, are coupled to the head support 112, and hold the patient's head against the headrest 118 as shown in FIGS. 1 and 8. When a patient's head is wrapped in the padded head support 10 moved into contact with the head support 112 as indicated by arrow 101 shown in FIG. 7, the headrest coupler 34 of the headrest pad 20 engages the first coupler patch 120 of the head support 112. Then, the second strap 124 is passed over the forehead band 22 and the first side 126 of the second strap 124 engages the forehead band 22 to hold the patient's head against the headrest 118. Then the first strap 122 is passed over the second strap 124, as indicated by arrow 103 as shown in FIG. 8, and the first side 126 of the first strap 122 engages the second side 128 of the second strap 106.

Additional details regarding the surgical head support apparatus 110 are provided in U.S. application Ser. No. 12/948,815 which is filed concurrently herewith, which is titled "Surgical Head Support Apparatus" and which is hereby incorporated by reference herein.

Figure 9:
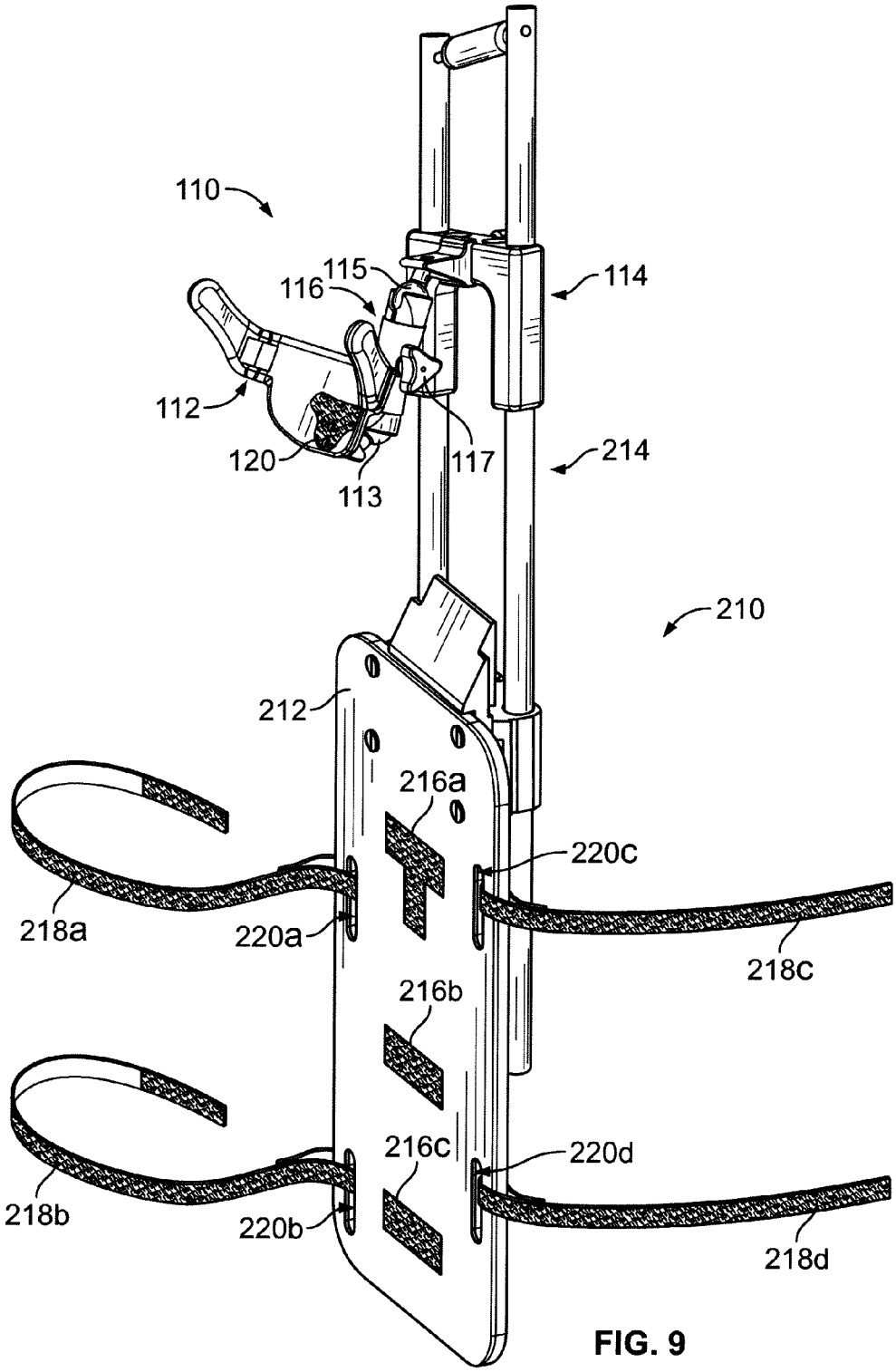
FIG. 9 is a front elevation view of an alternative operating room table adapter coupled to the surgical head support apparatus of FIG. 1, the alternative operating room table adapter having couplers configured to secure the operating room table adapter to a surgical table.
Figure 10:
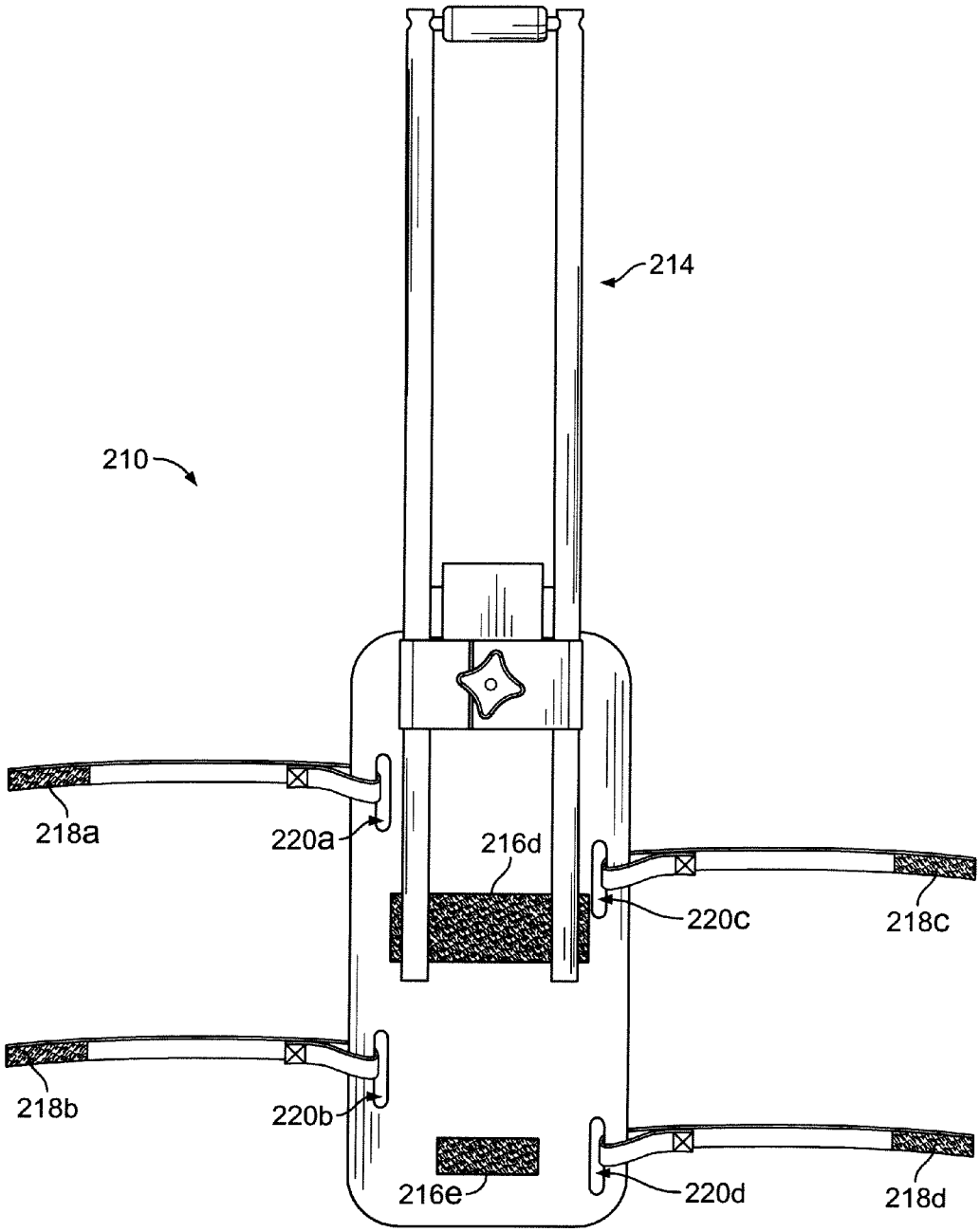
FIG. 10 is a rear elevation view of the alternative operating room table adapter of FIG. 9 showing additional couplers configured to secure the operating room table adapter to a surgical table.

The bracket 114 of the surgical head support apparatus 110 is coupled to an operating room table adapter 210 for slidable movement relative thereto. The operating room table adapter 210 includes an adapter board 212 and a rail assembly 214 extending beyond an edge of the adapter board 212 as shown in FIGS. 9 and 10. The adapter board 212 includes front face couplers 216*a*, 216*b*, 216*c* configured to engage a mattress and back face couplers 216*d*, 216*e* configured to engage a portion of a surgical table. Illustratively, front face couplers 216*a*, 216*b*, 216*c* are made from patches of hook material and back face couplers 216*d*, 216*e* are made from patches of loop material. In other embodiments, the front face couplers 216*a*, 216*b*, 216*c* may be made from patches of loop material and back face couplers 216*d*, 216*e* may be made from patches of hook material. The adapter board 212 further includes straps 218*a*, 218*b*, 218*c*, 218*d* that extend through slots 220*a*, 220*b*, 220*c*, 220*d* formed in the adapter board 212. The straps 218*a*, 218*b*, 218*c*, 218*d* are configured to wrap around at least a portion of a surgical table so that the adapter board 212 is secured to the surgical table.

Additional details regarding the operating room table adapter 210 are provided in U.S. application Ser. No. 12/948,820 which is filed concurrently herewith, which is titled "Operating Room Table Adapter" and which is hereby incorporated by reference herein.

Based on the foregoing, it will be understood that the padded head support 10 attaches in two pieces to a patient's head before the patient's head is secured to the surgical head support apparatus 110. The padded head support 10 is intended for a single use prior to disposal. In other embodiments, the padded head support 10 may be constructed for multiple uses and to withstand cleaning between uses. Some devices in the prior art are removable from a patient brace or support to allow cleaning of the devices but they typically are attached to the patient brace or support before they can receive or be secured to a patient. Devices that attach to the patient brace or support before they receive or secure a patient may allow the device to float relative to a part of the patient supported by the device. Attaching the padded head support 10 to a patient's head before the patient's head is secured to the surgical head support apparatus 110 reduces the potential for the patient's head to float relative to the padded head support 10.

Although certain illustrative embodiments have been described in detail above, variations and modifications exist within the scope and spirit of this disclosure as described and as defined in the following claims.

The invention claimed is:

1. A padded head support for use with a surgical head support apparatus having a headrest, the padded head support comprising a head wrap including a head wrap coupler and a headrest pad, the headrest pad adapted to be secured to the surgical head support apparatus, and a chin wrap including a chin pad, a chin band, and a chin wrap coupler, wherein the head wrap forms a first closed loop around a patient's forehead and a back of the patient's head, the chin pad and the chin band of the chin wrap form a second closed loop around the patient's chin and a top of the patient's head, the chin wrap engaging the head wrap at two locations, the head wrap coupler holding the head wrap in the first closed loop, and the chin wrap coupler holding the chin pad and the chin band of the chin wrap in the second closed loop, and the chin pad and the chin hand are formed from a monolithic piece of material.

2. The padded head support of claim 1, wherein the head wrap further includes a forehead band including a first portion extending from a first side of the headrest pad and a second portion extending from a second side of the headrest pad, and the second side of the headrest pad is spaced apart from the first side of the headrest pad.

3. The padded head support of claim 2, wherein the head wrap coupler is coupled to the first portion and engages the second portion of the forehead band.

4. The padded head support of claim 2, wherein the headrest pad has a top surface and a bottom surface, the first portion and the second portion of the forehead band have a top surface and a bottom surface, and the bottom surface of the headrest pad extends below the bottom surface of the first portion and the second portion of the forehead band.

5. The padded head support of claim 4, wherein the headrest pad and the forehead band include material that adheres to hook material.

6. The padded head support of claim 1, wherein the head wrap coupler faces outwardly from a first side of the head wrap and is configured to engage a second side of the head wrap.

7. The padded support of claim 6, wherein the head wrap is made from a material that adheres to hook material.

8. The padded head support of claim 7, wherein the head wrap coupler is made from hook material.

9. The padded head support of claim 2, wherein the headrest pad and the forehead band are formed from a monolithic piece of material.

10. The padded head support of claim 1, wherein the chin band has a first portion extending from a first side of the chin pad and a second portion extending from a second side of the chin pad, the second side spaced apart from the first side, and the chin wrap coupler is coupled to the first portion and engages the second portion of the chin band.

11. A padded head support for use with a surgical head support apparatus having a headrest and a headrest securing member, the padded head support comprising a head wrap including a headrest pad and a forehead band, the forehead band having a first portion extending from a first side of the headrest pad and a second portion extending from a second side of the headrest pad, and a chin wrap including a chin pad and a chin band, wherein the head wrap is movable between a first position where the first portion and the second portion of the forehead band are positioned in spaced apart relation from one another and a second position where the first portion and the second portion of the forehead band are engaged with one another forming a first closed loop.

12. The padded head support of claim 11, wherein the head wrap further includes a head wrap coupler and the head wrap coupler is situated between the first portion and the second portion of the forehead band when the forehead band is in the second position.

13. The padded head support of claim 11, wherein the headrest pad is secured to the headrest when the forehead band is in the second position.

14. The padded head support of claim 13, wherein the forehead band is situated between the headrest and the headrest securing member when the forehead band is in the second position.

15. The padded head support of claim 11, wherein the chin wrap includes a chin pad and a chin band, the chin band having a first portion extending from a first side of the chin pad and a second portion extending from a second side of the chin pad, and the chin wrap is movable between a first position where the first portion and the second portion of the chin band are positioned in spaced apart relation from one another and a second position where the first portion and the second portion of the chin band are engaged with one another forming a second closed loop with the chin pad.

16. The padded head support of claim 15, wherein the chin band engages the forehead band in two locations when the forehead band is in the second position and the chin band is in the second position.

17. The padded head support of claim 16, wherein the chin band is situated between the forehead band and the headrest securing member at the two locations where the chin band engages the forehead band.

18. The padded head support of claim 15, wherein the chin wrap further includes a chin wrap coupler and the chin wrap coupler is situated between the first portion and the second portion of the chin band when the chin band is in the second position.

19. The padded head support of claim 15, wherein the chin pad and the chin band are formed from a monolithic piece of material.

20. The padded head support of claim 11, wherein the headrest pad and the headrest band are formed from a monolithic piece of material.

21. A method of wrapping a patient's head in a padded head support before coupling the padded head support to a surgical table having a surgical head support apparatus, the method comprising wrapping a head wrap including a headrest pad and a forehead band around the patient's head so that the headrest pad is positioned to cover the back of the patient's head and the forehead band is positioned to cover the patient's forehead, wrapping a chin wrap around the patient's head so that the chin wrap is positioned under the patient's chin and the chin wrap engages the head wrap at two locations, and then securing the padded head support to the surgical head support apparatus, wherein the head wrap and the chin wrap are wrapped around the patient's head before securing the padded head support to the surgical head support apparatus.

22. The method of claim 21, wherein securing the headrest pad to the surgical head support apparatus comprises at least on of wrapping a strap of the surgical head support apparatus around the head wrap and attaching a first coupler of the head wrap to a second coupler of the surgical head support apparatus.

23. A patient head support for use with a surgical table, the patient head support comprising a padded head support including a head wrap having a head wrap coupler and a chin wrap having a chin wrap coupler, a surgical head support apparatus including a head support with a headrest having a first coupler, a bracket, and a joint member situated between the head support and the bracket and coupled to the head support and to the bracket, and an operating room table adapter including an adapter board, at least one rail extending beyond the adapter board, and at least one coupler securing the adapter board to the surgical table, wherein the padded head support is adapted to be secured to the headrest, the head wrap forms a first closed loop around a patient's forehead and a back of the patient's head, the chin wrap forms a second closed loop around the patient's chin and a top of the patient's head, the chin wrap engaging the head wrap at two locations, the head wrap coupler holding the head wrap in the first closed loop, and the chin wrap coupler holding the chin wrap in the second closed loop, and the second head support handle extends in a second plane tangent to the curve.

24. The patient head support of claim 23, wherein the at least one coupler of the operating room table adapter is one of a hook material patch, a loop material patch, and a strap.

25. The patient head support of claim 23, wherein the joint member of the surgical head support apparatus engages a first spherical joint extending from the head support and a second spherical joint extending from the bracket and the joint member is movable between a locked position, blocking movement of the first and the second spherical joints, and an unlocked position, allowing movement of the first and the second spherical joints.

26. The patient head support of claim 25, wherein the joint member is moved between the locked position and the unlocked position by a joint lock knob.

27. The patient head support of claim 23, wherein the head wrap of the padded head support is adapted to be secured to the headrest of the surgical head support apparatus by one of a hook material patch situated between the padded head support and the headrest, a loop material patch situated between the padded head support and the headrest, and a strap extending over at least a portion of the head wrap.

28. The patient head support of claim 23, wherein the head wrap includes a forehead band having a left portion and a right portion, a headrest pad coupled between the left portion and the right portion of the forehead band and sized to extend downwardly from the forehead band, and a headrest coupler formed from a patch of hook and loop material coupled to a back side of the headrest pad to couple the head wrap to the headrest.

* * * * *